US005899531A

United States Patent [19]

Koehler

[11] Patent Number: 5,899,531

[45] Date of Patent: May 4, 1999

[54] STATIONARILY-MOUNTED SEATING STRUCTURE

[75] Inventor: Karl J. Koehler, Brillion, Wis.

[73] Assignee: Krueger International, Inc., Green Bay, Wis.

[21] Appl. No.: 08/700,293

[22] Filed: Aug. 20, 1996

[51] Int. Cl.[6] ..... A47C 1/022

[52] U.S. Cl. ..... 297/335; 297/331; 297/337; 297/332

[58] Field of Search ..... 297/331, 332, 297/335, 337, 411.38, 378.1, 354.1, 354.11, 333

[56] References Cited

U.S. PATENT DOCUMENTS

| | | | |
|---|---|---|---|
| 444,101 | 1/1891 | Miller . | |
| 1,290,557 | 1/1919 | Hill . | |
| 1,435,741 | 11/1922 | Sadler . | |
| 1,887,240 | 11/1932 | Hanson | 297/331 |
| 1,973,178 | 9/1934 | Sass . | |
| 2,124,893 | 7/1938 | Peppas . | |
| 2,336,128 | 12/1943 | Ronk . | |
| 2,582,599 | 1/1952 | Nordmark . | |
| 2,610,669 | 9/1952 | Bromagem . | |
| 2,646,841 | 7/1953 | Sellers . | |
| 2,652,881 | 9/1953 | Rowe | 297/332 |
| 2,705,526 | 4/1955 | Hoven et al. . | |
| 2,715,434 | 8/1955 | Lukens . | |
| 2,913,039 | 11/1959 | Mauser . | |
| 3,163,409 | 12/1964 | Running et al. . | |
| 3,194,601 | 7/1965 | Hoven et al. . | |
| 3,287,060 | 11/1966 | Thompson | 297/332 |
| 3,572,826 | 3/1971 | Barnes . | |
| 3,638,998 | 2/1972 | Anderson . | |
| 3,730,601 | 5/1973 | Misenheimer, III . | |
| 3,813,149 | 5/1974 | Lawrence, III et al. . | |
| 4,189,876 | 2/1980 | Crossman et al. . | |
| 4,211,450 | 7/1980 | Sutter . | |
| 4,861,108 | 8/1989 | Acton et al. . | |
| 5,257,852 | 11/1993 | Tsuneki et al. | 297/335 |
| 5,393,120 | 2/1995 | Woods et al. . | |

FOREIGN PATENT DOCUMENTS

| | | |
|---|---|---|
| 515823 | 12/1952 | Belgium . |
| 669162 | 12/1938 | Germany . |
| 235586 | 3/1926 | United Kingdom . |

OTHER PUBLICATIONS

Brochure titled "Ikria", JG Furniture Systems, Quakertown, PA 18951, undated.

Brochure titled "Theatrum Series", Assigned Manufacturing Group, P. O. Box 3786, Industry, CA 91744, undated.

Brochure titled "Auditorium Seating", JG Furniture Systems, Quakertown, PA 18951, undated.

Brochure titled "The Citation", Adirondack Direct, Long Island City, NY 11106, undated.

*Primary Examiner*—Peter M. Cuomo
*Assistant Examiner*—Anthony D. Barfield
*Attorney, Agent, or Firm*—Andrus, Sceales, Starke & Sawall

[57] ABSTRACT

A stationarily-mounted seating structure consists of a pair of spaced supports, a seat pivotably mounted between the spaced supports and a back fixed to the spaced supports. Each spaced support includes forward and rearward vertical support members and the seat is mounted to the forward vertical support member while the back is mounted to the rearward vertical support member. A pivot mechanism for pivotably mounting the seat between the supports includes a shaft extending between and connecting the forward vertical support members. A stop element is fixed on the shaft for limiting the range of pivotable movement of the seat. A bushing is secured to the seat and is formed with an inner bearing surface for rotatably supporting the shaft, and outer bearing surfaces for engaging the stop element as well as a shroud which conceals the stop element, the bushing and a portion of the shaft. A foot bracket is mounted to each end of the shaft, and a platform bracket is mounted to the forward vertical support member. A threaded fastener secures the foot bracket to the platform bracket, and a slot in the foot bracket enables adjacent foot brackets to be placed at an angle to each other for use in a radiused installation.

30 Claims, 4 Drawing Sheets

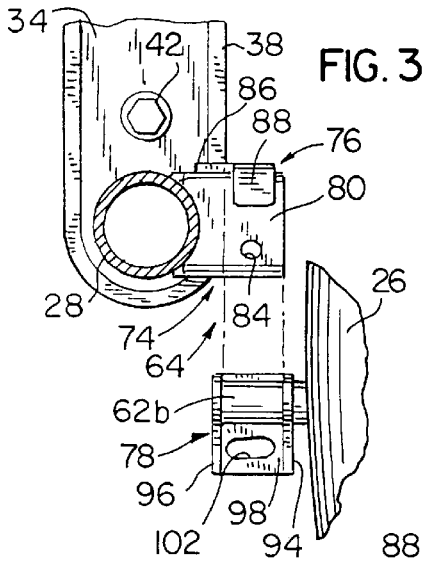
FIG. 3A
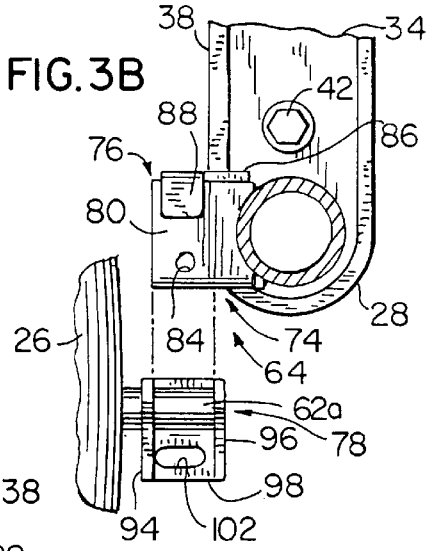
FIG. 3B
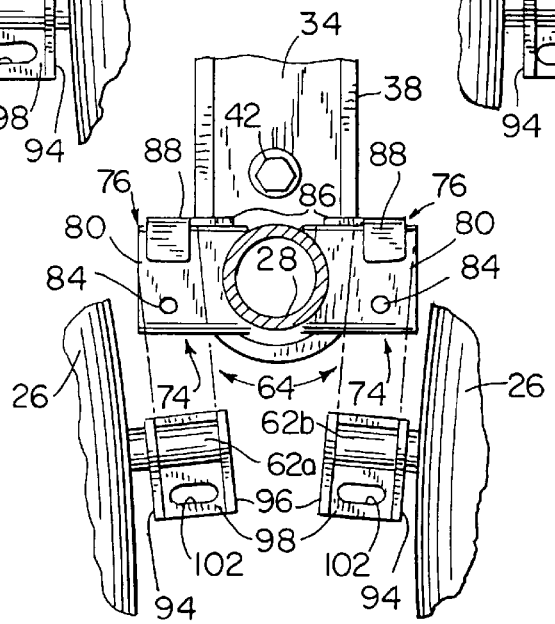
FIG. 3C
FIG. 5
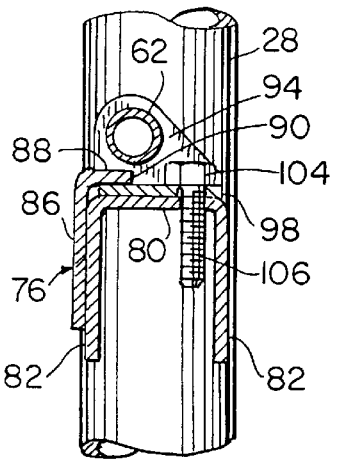
FIG. 4
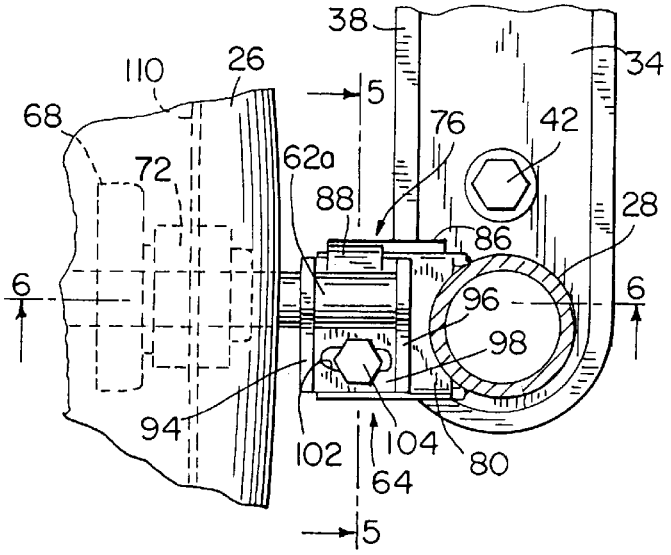

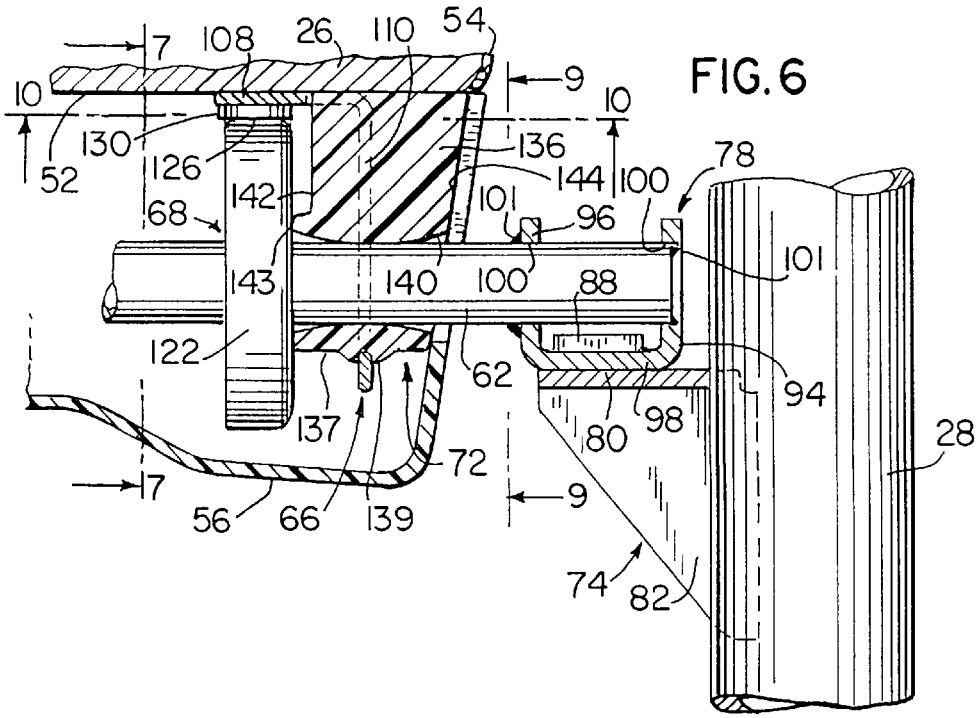
FIG. 6
FIG. 7
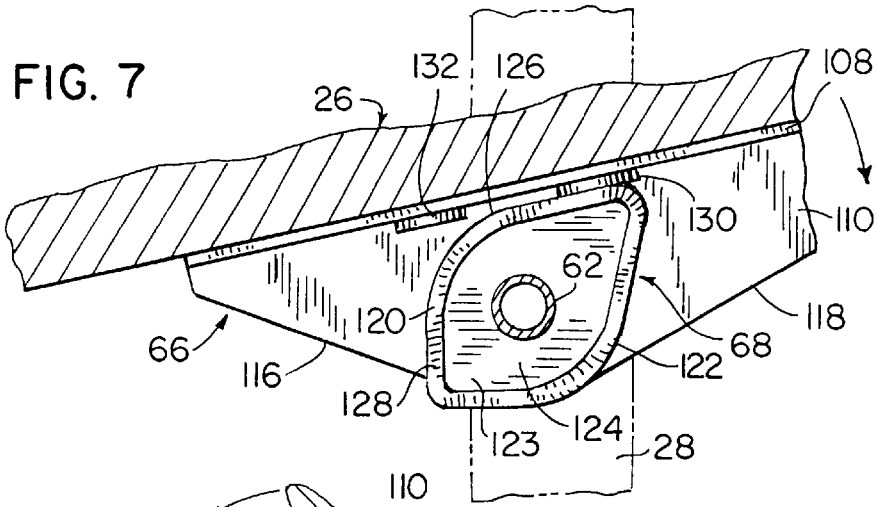
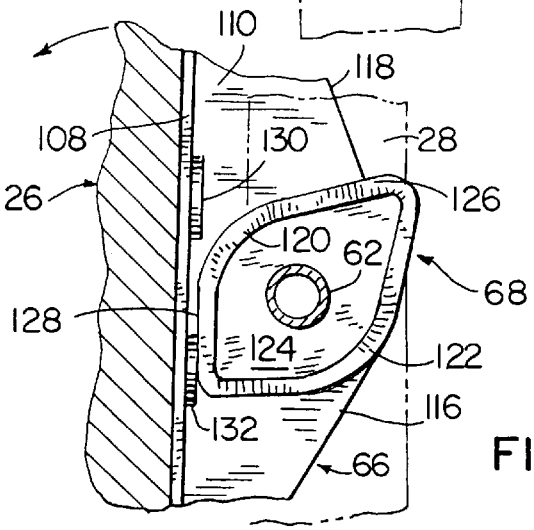
FIG. 8

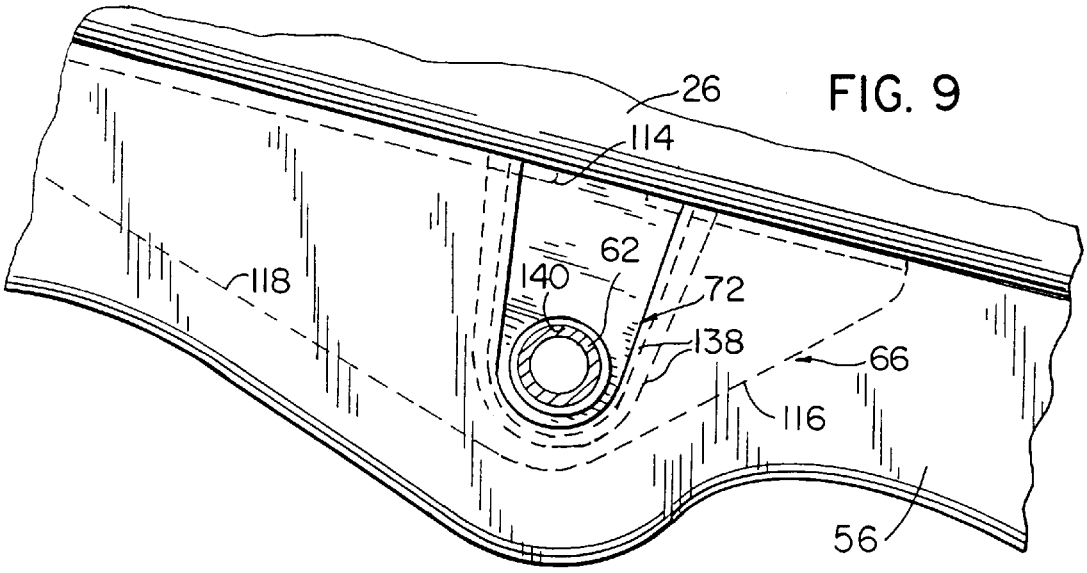
FIG. 9
FIG. 10
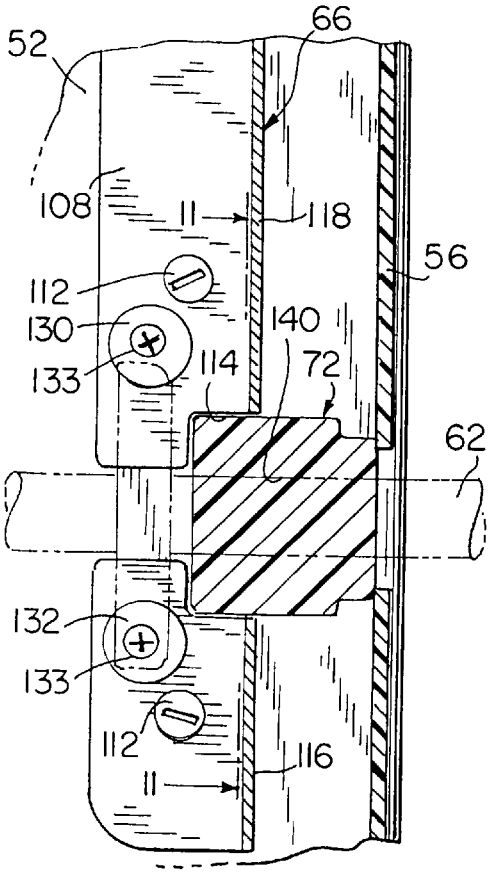
FIG. 11
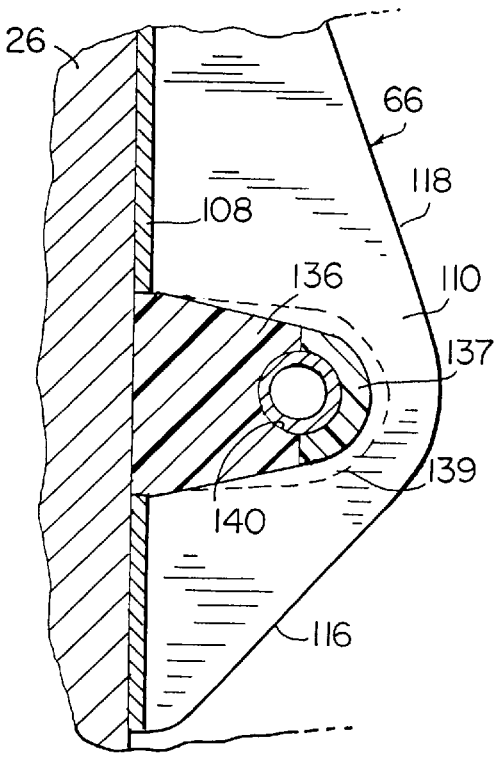

STATIONARILY-MOUNTED SEATING STRUCTURE

FIELD OF THE INVENTION

This invention relates broadly to a stationarily-mounted seating structure, such as is used in row formation in an auditorium, theater, or the like, and more particularly, pertains to a pivotable seat mounting assembly for such a seating structure.

BACKGROUND AND SUMMARY OF THE INVENTION

A stationarily-mounted seating structure is typically mounted to the floor or other supporting surface of an auditorium, theater or the like, and generally includes a support located on each side of the structure, with a seat and a back disposed between and mounted to the supports. In some applications, the back is fixedly connected to the supports, and the seat is pivotably mounted to the supports for movement between a lowered, operative position and a raised, storage position.

It is an object of the present invention to provide a stationarily-mounted seating structure which is relatively simple in its construction and assembly, and which provides a unique design for the mounting of the seat thereto. It is a further object of the invention to provide a fixed position seating structure which is readily installed in a desired straight or curved row alignment and which is sturdy and long-lasting throughout continuous use. It is a further object of the invention to provide an improved mechanism for pivotably mounting the seat between supports for repeated movement between its lowered, operative position and its raised, storage position, as when the seat occupant rises to allow others to pass by. A still further object of the invention is to provide a compact and easily assembled, permanently located seating structure having a high degree of comfort for the seat occupant. Yet another object of the invention is to provide an auditorium or theater-type seating system displaying a distinctive, aesthetically appealing appearance.

In accordance with one aspect of the invention, a stationarily-mounted seating structure includes a pair of spaced supports, each of which includes a forward vertical support member and a rearward vertical support member, the supports being fixed to a support surface. A cross-member, preferably in the form of a shaft having a pair of opposed ends, extends between and connects the forward vertical support members. A seat is pivotably mounted on the cross-member for movement between a lowered, operative position and a raised, storage position. A back is mounted to and between the rearward vertical support members. The seating structure includes a pivot arrangement mounted adjacent each outermost edge of the seat for pivotably mounting the seat to the cross-member and limiting the range of pivoting movement of the seat. The pivot arrangement includes a stop element fixed on the cross-member and engageable with the seat, and a bushing mounted to the seat. The cross-member extends through the bushing so that the seat is pivotable about a pivot axis defined by the cross-member. The pivot arrangement also includes a bracket arrangement joining each of the ends of the shaft to one of the forward vertical support members. The bushing is a split member having an upper segment and a lower segment and is disposed between the stop element and the bracket arrangement. The bushing has a bottom wall fixed to the seat and a pair of non-parallel sidewalls, and a first one of the sidewalls is engageable against the stop element. A pivot brace is interposed between the sidewalls of the bushing, and a shroud is mounted to the seat for enclosing a portion of the cross-member, the stop element and the bushing. A second one of the sidewalls of the bushing is engageable with the shroud.

In another aspect of the invention, a seating structure has a pair of spaced supports fixed to a support surface and a seat pivotably disposed between the supports. Each of the supports includes a forward vertical support member and a rearward vertical support member. An assembly for pivotably mounting the seat to each of the forward vertical support members includes a shaft extending between and connecting the forward vertical support members, the shaft defining an axis about which the seat is pivoted. A bushing is fixedly mounted to the seat for rotation about the shaft, and a stop element is fixedly connected to the shaft against the bushing. A cushioning arrangement is mounted to the seat and is selectively engageable with the stop member to limit movement of the seat in the first direction and the second direction of pivoting movement of the seat. The stop element includes a curved engagement surface having an upper portion and a lower portion. The cushioning arrangement includes a first cushion limiting the pivoting of the seat to a lowered, operative seat position, and a second cushion spaced from the first cushion and limiting the pivoting of the seat in the second direction to a raised, inoperative position. The first cushion is engageable with the upper portion of the stop element and the second cushion is engageable with the lower portion of the stop element. The shaft has a pair of opposed ends, each of the ends being joined to one of the forward vertical support members by a bracket arrangement. The bracket arrangement includes a platform bracket fixedly secured to the forward vertical support member, a mounting tab extending from the platform bracket, and a foot bracket joined to one of the ends of the shaft between the platform bracket and the mounting tab. The assembly includes a pivot brace having a substantially horizontally disposed section fixedly attached to the seat and a substantially vertically extending section having an opening for accommodating the bushing. The cushioning arrangement is located on the substantially horizontally disposed section of the pivot brace, and the bushing is supported on the substantially vertically extending section of the pivot brace. The assembly includes a shroud secured to the seat and enclosing the bushing, the stop element and at least a portion of the shaft. The bushing has a thrust surface engageable against the stop member and a flared surface engageable and contoured with the shroud. A counterweight is mounted to the seat for urging the seat to pivot in the second direction. The bushing, the stop element and the cushioning arrangement are all located externally of the seat. The bushing has an upper segment and a lower segment, each of the segments being arcuately recessed to rotatably receive the shaft.

In accordance with yet another aspect of the invention, a seating assembly has a pair of spaced support members and a seat located between the support members, the seat defining a pair of sides and a lower surface extending therebetween. A seat mounting mechanism for pivotally mounting the seat between the support members includes a shaft extending between and connecting the support members, the shaft having a pair of opposed ends. A stop element is fixed on the shaft and is engageable with the seat for limiting the range of pivotal movement of the seat. A bushing is secured to the lower surface of the seat along each of the sides thereof and has an inner bearing surface for pivotably supporting the seat on the shaft and an outer bearing surface engageable with the stop element. The mechanism includes a pivot brace secured to the seat and supporting the bushing. A shroud is secured to the seat for concealing the stop element, the bushing and a portion of the shaft. The bushing has another outer bearing surface engageable with the shroud. The mechanism also includes a bracket arrangement for mounting each of the opposed ends of the shaft to one of the support members. The bracket arrangement includes a platform bracket fixedly connected to one of the support members, the platform bracket being formed with a hole therethrough. A mounting tab is joined to the platform bracket, and a foot bracket is fixed to one of the ends of the shaft and positioned between the mounting tab and the platform bracket. The foot bracket is formed with a slot and is movable throughout a range of positions in which the slot is aligned with the hole in the platform bracket to accommodate a curved or straight alignment in a row of seating assemblies. A fastener is passed through the hole and the slot for securing the platform bracket to the foot bracket after the seat is in its desired position relative to the support member.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIGS. 3A and 3B are partial top plan views, partially in section, and partially in exploded view, illustrating the outermost components of the pivot assemblies shown in FIG. 2 on the right side and left side, respectively, of the seating assembly constructed as in FIGS. 1 and 2;

FIG. 3C is a partial top plan view, partially in section, and partially in exploded view, illustrating the outermost components of pivot assemblies for adjacent seating assemblies mounted in a curved row alignment;

FIG. 4 is a left side view similar to that depicted in FIG. 3B but showing the outermost components of the pivot assembly in assembled form and the innermost components of the pivot assembly in phantom;

FIG. 5 is a sectional view taken on line 5—5 of FIG. 4;

FIG. 6 is a partial sectional view taken on line 6—6 of FIG. 4;

FIG. 7 is a partial sectional view taken on line 7—7 of FIG. 6 showing the seat being pivoted to its lowered, operative position;

FIG. 8 is a sectional view similar to FIG. 7, but showing the seat pivoted to its raised, inoperative position;

FIG. 9 is a partial sectional view taken on line 9—9 of FIG. 6;

FIG. 10 is a partial sectional view taken on line 10—10 of FIG. 6; and FIG. 11 is a partial sectional view taken on line 11—11 of FIG. 10.

DETAILED DESCRIPTION OF THE PREFERRED EMBODIMENT

Figure 1:
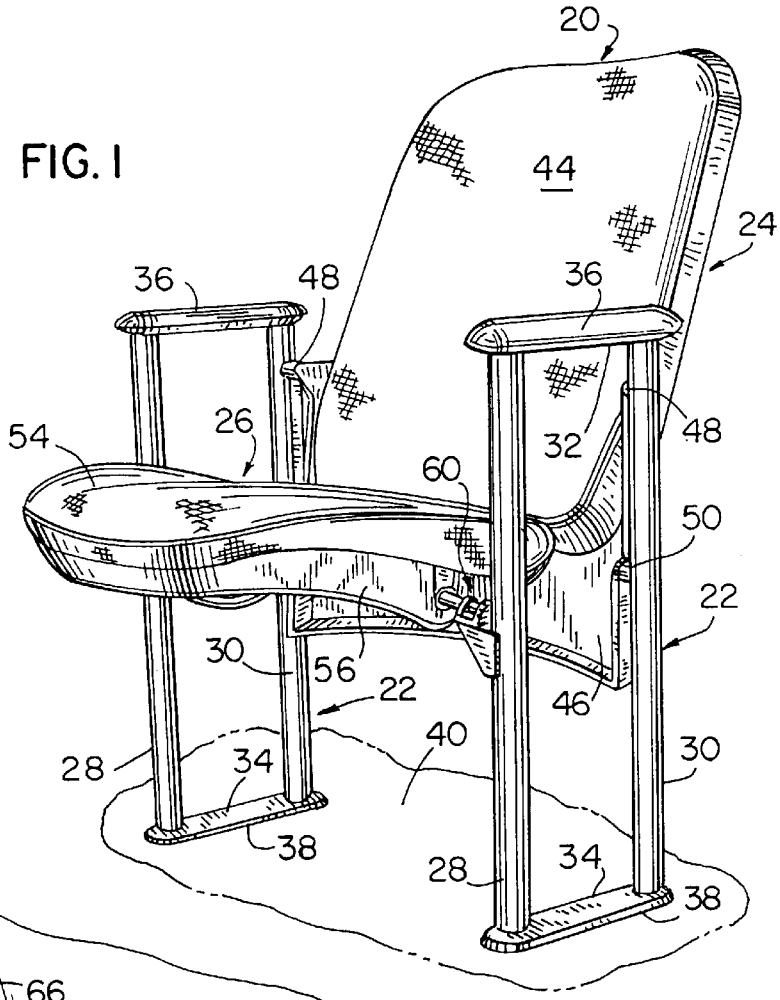
FIG. 1 is an isometric view of a stationarily-mounted seating assembly constructed according to the invention.

FIG. 1 illustrates a single stationarily-mounted seating assembly 20 which generally includes a pair of spaced supports 22, a back 24 fixedly joined between supports 22, and a seat 26 pivotably mounted between supports 22. In a manner as is well known, seating assembly 20 is adapted for installation in rows, in which one or both of supports 22 are common to an adjacent seating assembly constructed substantially identically to seating assembly 20.

Each support 22 has a substantially identical construction and includes a forward vertical support member 28 defining an upper end and a lower end, and a rearward vertical support member 30 defining an upper end and a lower end. Support members 28, 30 may have any satisfactory shape and, as illustrated, are in the form of round tubular members. Support members 28, 30 are welded at their upper ends to a top plate 32, and are welded at their lower ends to a bottom plate 34.

Each top plate 32 is joined to an arm cap 36 to define an armrest at the upper end of support 22. Each bottom plate 34 includes a depending peripheral lip 38, the lower edge of which engages a floor 40 or other supporting surface. Openings are formed in bottom plates 34 and receive anchor bolts 42 (FIGS. 3 and 4) or the like for securing bottom plates 34, and thereby supports 22, to floor 40.

Back 24 includes a conventionally cushioned member 44 interconnected with a curved shell 46 which is connected at an upper point 48 and a lower point 50 along each rearward vertical support member 30. Further details of the construction and operation of supports 22 and back 24 are as set forth in co-pending patent application Ser. No. 08/372,229, filed Jan. 13, 1995, the disclosure of which is hereby incorporated by reference.

Figure 2:
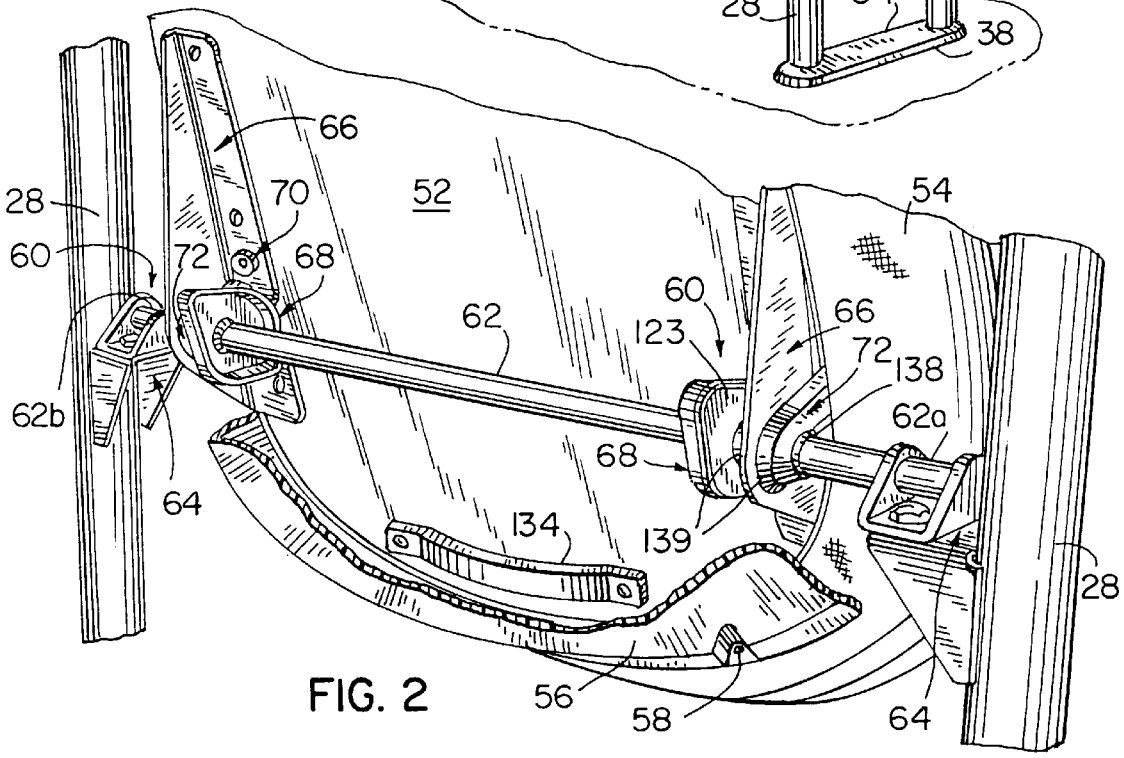
FIG. 2 is an enlarged, partial isometric view of a pivot assembly for pivotably mounting the seat in the seating assembly of FIG. 1.

As seen in FIGS. 1 and 2, seat 26 generally consists of a seat board 52 forming a bottom surface, a conventional cushion (not shown) overlying seat board 52, and a decorative and protective upholstery covering 54 which surrounds the cushion and extends inwardly about the periphery of seat board 52. A shroud 56 is removably attached to bottom surface 52 by means of screw-type fasteners, one of which is shown at 58. Shroud 56 functions to conceal the mechanism about which the seat 26 is pivoted and provides seat assembly 20 with a pleasing, flowing contour to enhance the appearance thereof. In a manner to be explained, seat 26 is mounted between forward vertical support members 28 of spaced supports 22 approximately midway between top plates 32 and bottom plates 34 for pivoting movement between a raised, inoperative or storage position shown in FIG. 2, and a lowered, operative or occupied position shown in FIG. 1.

As best seen in FIG. 2, a pair of identical seat mounting or pivot mechanisms 60 are provided on right and left sides adjacent bottom surface 52 and outermost edges of seat 26. Each pivot mechanism 60 comprises a shaft 62, a bracket assembly 64, a pivot brace 66, a stop element 68, a cushioning arrangement 70 and a bushing 72.

Shaft 62 is an elongated, rigid cross-member having a circular cross-section and a pair of spaced, opposed ends 62*a*, 62*b*, each of which is ultimately fixedly joined generally perpendicularly to one of the forward vertical support members 28 by bracket assembly 64. Otherwise stated, shaft 62 is disposed along the bottom of seat 26 and extends transversely between and connects the forward portions of spaced supports 22 in order to define a fixed support element. Seat 26 is pivotably mounted to shaft 62 for movement between its raised and lowered positions, such that the longitudinal axis of shaft 62 defines the pivot axis for seat 26.

FIGS. 3A and 3B depict the outermost components of each identical pivot mechanism 60 on the right side and left side, respectively, of seating assembly 20 as viewed by a person occupying the seat 26. FIG. 3C illustrates the outermost components of pivot mechanisms 60 connected on either side of forward vertical support member 28 when installing seats in a curved row alignment. In particular, each bracket assembly 64 is presented in a partially exploded view and consists of a platform bracket 74 secured to a forward vertical support member 28, a mounting tab 76 connected to the platform bracket 74, and a foot bracket 78 joined to one of the opposed ends 62*a*, 62*b* of the shaft 62 and engageable with platform bracket 74 and mounting tab 76.

With further reference to FIG. 3B and the assembled left side view shown in FIG. 4 and the sectional views of FIGS. 5 and 6, platform bracket 74 includes a generally flat, horizontal platform 80 from which a pair of parallel, generally triangular-shaped flanges 82 integrally and downwardly depend. Platform 80 is formed with a threaded circular mounting hole 84 at its forward end and has a curved cut-out along one edge for receiving tubular support member 28. Platform bracket 74 is preferably welded to support member 28 along the innermost, interfacing surfaces of support member 28 and the platform 80 and flanges 82 of platform bracket 74. Mounting tab 76 is secured to the rearward flange 82 of platform bracket 74, such as by welding. Mounting tab 76 defines a vertically disposed plate 86 secured to rearward flange 82 and a finger-like tab 88 extending upwardly from plate 86 and forwardly over platform 80 to define a horizontally disposed guide channel 90.

Foot bracket 78 is in the form of a generally upright, U-shaped clevis having an inner plate 94 and an outer plate 96 extending vertically from a horizontal base 98 which is supportable upon platform 80. Inner plate 94 and outer plate 96 are suitably formed with horizontally aligned recesses 100 (FIG. 6) through which one of the opposed shaft ends 62*a*, 62*b* is passed for connection, such as by welding 101, to the portions of plates 94, 96 adjacent the recesses 100. Base 98 is provided with a transverse slot 102 which is alignable with mounting hole 84 when base 98 is slidably guided upon platform 80 into guide channel 90 and against mounting tab 76. A bolt 104 extends through mounting hole 84 and slot 102 and has a threaded shaft 106 (FIG. 5) engaging the threads of mounting hole 84 so as to project vertically therethrough. As seen in FIG. 3, mounting hole 84 and slot 102 enable foot bracket 78 to be pivoted on platform 80 about a vertical axis defined by bolt 104, and to be moved inwardly and outwardly along the length of the slot 102. When foot bracket 78 is positioned, as desired, relative to platform bracket 74, bolt 104 is sufficiently tightened down to clamp base 98 against platform 80 to thereby fix the position of the foot bracket 78 and attached shaft 62 relative to the fixed platform bracket 74 and forward vertical support member 28, as represented in FIG. 4.

As can be appreciated, mounting tab 76 functions to prevent upward movement of the rear end of base 98 when seat 26 is pivoted to its operative position and occupied. In addition, tab 76 functions to engage foot bracket 78 when mounting seat 26 to support 22, to position foot bracket 78 on platform 80 before such components are secured together via bolt 104.

Reference is briefly made to FIGS. 2 and 6 for a general explanation of the innermost components of each identical pivot mechanism 60, namely pivot brace 66, stop element 68, cushioning arrangement 70 and bushing 72. Each of these components may be commonly described as being mounted with respect to fixed shaft 62 beneath and externally of seat 26 and at a position inwardly of protective shroud 56. It should be understood that pivot brace 66 and bushing 72 are fixed to seat 26 between shroud 56 and stop element 68 in a manner to be described which will allow seat 26, shroud 56, pivot brace 66 and bushing 72 to be rotatable relative to fixed shaft 62, bracket assembly 64 and stop element 68.

Turning now to FIGS. 2, 6 and 10, pivot brace 66 is an elongated, angled element including a substantially horizontally disposed, rectangularly-shaped upper wall 108 integrally formed at approximately a 90° angle with a substantially vertically disposed, triangularly-shaped wall 110. Horizontal wall 108 is formed with openings through which fasteners 112 (FIG. 10) are passed for screw-type engagement with the seat board 52 so as to fix pivot brace 66 to seat 26. Horizontal wall 108 and vertical wall 110 are provided with a socket 114 (FIG. 10) within which bushing 72 is received to provide pivoting movement of seat 26. Vertical wall 110 includes angled edges 116, 118 which define a heightened support surface on either side of which bushing 72 is disposed.

As best seen in FIGS. 2, 7 and 8, stop element 68 is a generally symmetrically-shaped cam element having a first curved lip 120 and a second curved lip 122 which are integrally formed with a vertical wall 123. Lips 120, 122 and wall 123 cooperate to define a recess 124. Wall 123 is formed with a central aperture for receiving shaft 62 which is secured such as by welding the periphery of shaft 62 to the portion of wall 123 about the aperture so that stop element 68 is non-rotatable relative to the shaft 62. First curved lip 120 defines an engagement surface having an upper stop portion 126 and a lower stop portion 128 which cooperate with cushioning arrangement 70 to establish the limiting range of pivoting movement of the seat 26 about shaft 62.

Stop element 68 is symmetrical, such that a pair of stop elements are mounted to shaft 62, one adjacent each side of seat 26, with recesses 124 facing each other. In this manner, the stop portions defined by curved lip 122 function as stop portions 126, 128 of curved lip 120 to limit the range of pivoting movement of seat 26.

Referring to FIGS. 7, 8 and 10, cushioning arrangement 70 consists of a pair of linearly aligned, cylindrical rubber bumpers or cushions 130, 132 which are secured to the underside of horizontal wall 108 of pivot brace 66 by fasteners 133 (FIG. 10) screwthreaded into seat board 52. First or forward cushion 130 moves along with seat 26 and pivot brace 66 as seat 26 is moved from its raised, storage position to its lowered, occupied position, and engages upper stop portion 126 of fixed stop element 68 when seat 26 is in its lowered, operative position (FIG. 7). Second or rearward cushion 132 is spaced rearwardly from first cushion 130, and also moves with seat 26 and pivot brace 66 as seat 26 is moved, and engages lower stop portion 128 of stop element 68 when seat 26 is in its raised, inoperative position (FIG. 8). A counterweight 134 (FIG. 2) is mounted externally to the extreme rear portion of seat board 52. Counterweight 134 acts to bias seat 26 towards its raised storage position when seat 26 is unoccupied, as is well known in the art. First and second cushions 130, 132 serve to silence and absorb the impact of stop element 68 as seat 26 is moved between its occupied and unoccupied positions.

As illustrated in FIGS. 6 and 9–11, bushing 72 is a pedestal-type, split member having an upper segment 136 with a bottom wall trapped against seat board 52 of seat 26, and a U-shaped lower segment 137 engaged with a lower wall of lower segment 136. Bushing 72 is formed with a series of peripheral strengthening ridges 138 (FIGS. 2, 9)

which define a center crest 139 best seen in FIG. 2. Upper and lower segments 136, 137 have mating arcuate surfaces which together form a lubricious inner bearing surface 140 for rotatably supporting the cylindrical shaft 62 therein. As seen in FIG. 6, inner bearing surface 140 is convexly-shaped in cross-section to provide a degree of deflection for shaft 62 on each side of the bushing 72 depending on the loads placed thereon. Bushing 72 is received in socket 114 of pivot brace 66 such that bushing 72 straddles socket 114 and vertical wall 110 of pivot brace 66 passes through the mid portion of bushing 72 (FIGS. 2 and 6) to provide internal support therefor. With further reference to FIG. 6, bushing 72 is formed with non-parallel sidewalls 142, 144. Innermost sidewall 142 has an annular thrust bearing surface 143 engageable against the outwardly facing surface of stop element wall 123. Opposite sidewall 144 is flared outwardly for flush engagement against an inner, downwardly extending wall of shroud 56.

Bushing 72 is constructed of any satisfactory material, and may preferably be a nylon material such as is known by the generic designation acetal.

With the arrangement described above, seat 26 is easily mountable to pivot mechanism 60 simply by securing each foot bracket 78 using bolt 104 to its respective platform bracket 74. In a similar manner, seat 26 can be easily removed by disconnecting each foot bracket 78 from its platform bracket 74, and lifting the seat 26 (along with shaft 62, pivot brace 66, stop element 68, cushioning arrangement 70, and bushing 72) from platform bracket 74. With this system, it is possible to quickly and easily remove seat 26 and replace it with a different seat.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. A stationarily-mounted seating assembly, comprising:

a pair of spaced support assemblies, each support assembly including forward and rearward support members spaced apart from each other along their entire length and having top and bottom ends, a top member secured between the top ends of each pair of forward and rearward support members and a bottom member secured between the bottom ends of each pair of forward and rearward support members and adapted for mounting to a support surface;

a cross-member extending between and connected to the forward support members without connection to the rearward support members, the cross-member having a pair of opposed ends;

a seat pivotably mounted on the cross-member for movement between a lowered, operative position and a raised, storage position, wherein the seat is solely supported by the forward support members; and a back mounted to and between the rearward support members.

2. The seating assembly of claim 1, wherein the seat and the cross-members make up a seat subassembly removably engageable with the forward support member.

3. The seating assembly of claim 2, wherein the seat is pivotably-mounted on the cross-member via a pivot arrangement mounted adjacent each edge of a pair of spaced edges defined by the seat for pivotably mounting the seat to each forward support member, wherein the pivot arrangement functions to limit the range of pivoting movement of the seat.

4. The seating assembly of claim 2, including a bracket mounted to each end of the cross-member for removably engaging the seat subassembly with the forward support member.

5. The seating assembly of claim 4, further comprising a second bracket mounted to the forward support member, and a removable engagement member for securing the first-mentioned bracket to the second bracket.

6. The seating assembly of claim 4, wherein the pivot arrangement includes a stop element fixed on the cross-member and engageable with the seat, and a bushing mounted to the seat for pivotably mounting the seat to the cross-member, and wherein the bushing is disposed between the stop element and the bracket.

7. A stationarily-mounted seating assembly, comprising:

a pair of spaced support assemblies, each support assembly including forward and rearward support members spaced apart from each other along their entire length and having top and bottom ends, a top member secured between the top ends of each pair of forward and rearward support members and a bottom member secured between the bottom ends of each pair of forward and rearward support members and adapted for mounting to a support surface;

a cross-member extending between and connected to the forward support members without connection to the rearward support members, the cross-member having a pair of opposed ends;

a seat pivotably mounted on the cross-member for movement between a lowered, operative position and a raised, storage position, wherein the seat is solely supported by the forward support members, wherein the seat is pivotably mounted on the cross-member via a pivot arrangement mounted adjacent each edge of a pair of spaced edges defined by the seat for pivotably mounting the seat to each forward support member, and wherein the pivot arrangement functions to limit the range of pivoting movement of the seat and includes a stop element fixed on the cross-member and engageable with the seat, and a bushing mounted to the seat for pivotably mounting the seat to the cross-member; and a back mounted to and between the rearward support members.

8. The seating assembly of claim 7, wherein the bushing has a bottom wall fixed to the seat and a pair of non-parallel sidewalls, one of the sidewalls being engageable against the stop element.

9. The seating assembly of claim 8, including a pivot brace interposed between the sidewalls of the bushing.

10. A stationarily-mounted seating assembly, comprising:

a pair of spaced supports, each of which includes a forward support member and a rearward support member, the supports being adapted for mounting to a support surface;

a cross-member extending between and connecting the forward support members, the cross-member having a pair of opposed ends;

a seat pivotably mounted on the cross-member for movement between a lowered, operative position and a raised, storage position, wherein the seat and the cross-member make up a seat subassembly removably engageable with the forward support member, wherein the seat is pivotably mounted on the cross-member via a pivot arrangement mounted adjacent each edge of a pair of spaced edges defined by the seat for pivotably mounting the seat to each forward support member, wherein the pivot arrangement functions to limit the range of pivoting movement of the seat, wherein the pivot arrangement includes a stop element fixed on the cross-member and engageable with the seat, and a bushing mounted to the seat for pivotably mounting the seat to the cross-member, wherein the bushing is split into an upper segment and a lower segment, each of which defines a recess within which a portion of the cross-member is received; and a back mounted to and between the rearward support members.

11. A stationarily-mounted seating assembly, comprising:

a pair of spaced support assemblies, each of which includes a forward support member and a separate rearward support member spaced from the forward support member, the support assemblies being adapted for mounting to a support surface;

a cross-member extending between and connected to the forward support members without connection to the rearward support members, the cross-member having a pair of opposed ends;

a seat pivotably mounted on the cross-member for movement between a lowered, operative position and a raised, storage position, wherein the seat is solely supported by the forward support members and wherein the seat and the cross-member make up a subassembly removably engageable with the forward support members;

a pivot arrangement fixedly attachable to the cross-member and mounted on the seat adjacent each edge of a pair of spaced edges defined by the scat for pivotably mounting the seat to each forward support member wherein the pivot arrangement functions to limit the range of pivoting of the seat, and includes a stop element fixed on the cross-member and engageable with the seat, and a bushing mounted to the seat for pivotably mounting the seat to the cross-member, wherein the bushing has a bottom wall fixed to the seat and a pair of non-parallel sidewalls wherein a first one of the bushing sidewalls is engageable against the stop element;

a back mounted to and between the rearward support members; and a shroud mounted to the seat for enclosing a portion of the cross-member, the stop element and the bushing, wherein a second one of the bushing sidewalls is engageable with the shroud.

12. In a seating assembly having a pair of spaced supports fixed to a support surface and a seat pivotably disposed between the supports, an assembly for mounting the seat to each of the supports for pivoting movement in a first direction and a second direction opposite the first direction, the assembly comprising:

a shaft extending between the supports the shaft defining an axis about which the seat is pivoted;

a bushing fixedly mounted to the seat and rotatable engaged with the shaft;

a stop element fixedly connected to the shaft wherein the stop element includes a curved engagement surface having an upper portion and a lower portion; and a cushioning arrangement interposed between the seat and the stop element for limiting movement of the seat in the first direction and the second direction of pivoting movement of the seat wherein the cushioning arrangement includes a first cushion mounted to the seat for limiting the pivoting movement of the seat in the first direction to a lowered, operative seating position and a second cushion mounted to the seat and spaced from the first cushion for limiting the pivoting movement of the seat in the second direction to a raised, inoperative position, the first cushion being engageable with the upper portion of the stop element and the second cushion being engageable with the lower portion of the stop element.

13. The assembly of claim 12, wherein the stop element is mounted to the shaft and includes a curved engagement surface having an upper portion and a lower portion.

14. In a seating assembly having a pair of spaced supports fixed to a support surface and a seat pivotably disposed between the supports, an assembly for mounting the seat to each of the supports for pivoting movement in a first direction and a second direction opposite the first direction, the assembly comprising a shaft extending between the supports, the shaft defining an axis about which the seat is pivoted, wherein the shaft has a pair of opposed ends, each of the ends being removably joined to the support by a bracket arrangement that includes a platform bracket fixedly secured to the support and defining an upwardly facing engagement surface, a mounting tab extending from the platform bracket, and a foot bracket joined to one of the ends of the shaft and having a base disposed between the platform bracket and the mounting tab, wherein the base includes a downwardly facing engagement surface engageable with the upwardly facing engagement surface of the mounting bracket.

15. In a seating assembly having a pair of spaced supports fixed to a support surface and a seat pivotably disposed between the supports, an assembly for mounting the seat to each of the supports for pivoting movement in a first direction and a second direction opposite the first direction, the assembly comprising:

a shaft extending between the supports, the shaft defining an axis about which the seat is pivoted, wherein the shaft has a pair of opposed ends, each of the ends being removably joined to the support by a bracket arrangement including a platform bracket fixedly secured to the support, a mounting tab extending from the platform bracket, and a foot bracket joined to one of the ends of the shaft and having a base disposed between the platform bracket and the mounting tab, wherein the foot bracket base is mounted to the platform bracket so as to be adjustable about a substantially vertical axis for accommodating substantially horizontal movement of the seat relative to the support;

a bushing fixedly mounted to the seat and rotatably engaged with the shaft;

a stop element fixedly connected to the shaft; and a cushioning arrangement interposed between the seat and the stop element for limiting movement of the seat in the first direction and the second direction of pivoting movement of the seat.

16. The assembly of claim 15, including a pivot brace having a substantially horizontally disposed section fixedly attached to the seat, and a substantially vertically extending section having a recess for accommodating the bushing.

17. The assembly of claim 16, wherein the substantially vertically extending section passes through the bushing.

18. The assembly of claim 15, including a shroud secured to the seat and enclosing the bushing, the stop element and at least a portion of the shaft.

19. The assembly of claim 15, including a counterweight mounted to the seat for urging the seat to pivot in the second direction.

20. The assembly of claim 15, wherein the shaft, the bushing, the stop element and the cushioning arrangement are all located externally of the seat.

21. The assembly of claim 15, herein the bushing has an upper segment and a lower segment, each of the segments being arcuately recessed to rotatably receive the shaft.

22. The assembly of claim 21, wherein the arcuate recesses of the upper and lower segments have a convex wall structure to accommodate deflection of the shaft.

23. In a seating assembly having a pair of spaced supports fixed to a support surface and a seat pivotably disposed between the supports an assembly for mounting the seat to each of the supports for pivoting movement in a first direction and a second direction opposite the first direction the assembly comprising:

a shaft extending between the supports the shaft defining an axis about which the seat is pivoted;

a bushing fixedly mounted to the seat and rotatably engaged with the shaft;

a stop element fixedly connected to the shaft a pivot brace having a substantially horizontally disposed section fixedly attached to the seat and a substantially vertically extending section having a recess for accommodating the bushing; and a cushioning arrangement interposed between the seat and the stop element for limiting movement of the seat in the first direction and the second direction of pivoting movement of the seat wherein the cushioning arrangement is located on the substantially horizontally disposed section of the pivot brace.

24. In a seating assembly having a pair of spaced supports fixed to a support surface and a seat pivotably disposed between the supports an assembly for mounting the seat to each of the supports for pivoting movement in a first direction and a second direction opposite the first direction, the assembly comprising:

a shaft extending between the supports the shaft defining an axis about which the seat is pivoted;

a bushing fixedly mounted to the seat and rotatable engaged with the shaft;

a stop element fixedly connected to the shaft;

a shroud secured to the seat and enclosing the bushing the stop element and at least a portion of the shaft; and a cushioning arrangement interposed between the seat and the stop element for limiting movement of the seat in the first direction and the second direction of pivoting movement of the seat, wherein the bushing has a thrust surface engageable against the stop element and a flared surface engageable and contoured with the shroud.

25. In a seating assembly having a pair of spaced frame members and a seat located between the frame members, the seat defining a pair of sides and a lower surface extending therebetween, a seat mounting mechanism for pivotably mounting the seat between the frame members, the mechanism comprising:

a shaft extending between and connecting the frame members, the shaft having a pair of opposed ends;

a stop element separate from the shaft and fixed to the shaft and having at least one stop surface spaced outwardly from the shaft for engagement with the seat for limiting the range of pivotable movement of the seat; and a bushing secured to the lower surface of the seat, the bushing having an inner bearing surface for rotatably supporting the shaft therein for providing pivoting movement of the seat.

26. The mechanism of claim 25, including a pivot brace secured to the seat and supporting the bushing.

27. The mechanism of claim 26, including a shroud secured to the seat for concealing the stop element, the bushing and a portion of the shaft.

28. The mechanism of claim 25, including a bracket arrangement for mounting each of the opposed ends of the shaft to one of the frame members.

29. In a seating assembly having a pair of spaced frame members and a seat located between the frame members, the seat defining a pair of sides and a lower surface extending therebetween, a seat mounting mechanism for pivotably mounting the seat between the frame members, the mechanism comprising:

a shaft extending between and connecting the frame members, the shaft having a pair of opposed ends;

a stop element fixed on the shaft and engageable with the seat for limiting the range of movement of the seat;

a bushing secured to the lower surface of the seat, the bushing having an inner bearing surface for rotatably supporting the shaft therein; and a shroud secured to the seat for concealing the stop element, the bushing and a portion of the shaft;

wherein the bushing has a pair of outer bearing surfaces, one of which engages the stop element and the other of which engages the shroud.

30. In a seating assembly having a pair of spaced frame members and a seat located between the frame members, the seat defining a pair of sides and a lower surface extending therebetween, a seat mounting mechanism for pivotably mounting the seat between the frame members, the mechanism comprising:

a shaft extending between and connecting the frame members, the shaft having a pair of opposed ends;

a bracket arrangement for mounting each of the opposed ends of the shaft to one of the frame members, wherein the bracket arrangement comprises: a platform bracket fixedly mounted to one of the frame members, the platform bracket being formed with a hole therethrough; a mounting tab joined to the platform bracket; a foot bracket fixed to one of the ends of the shaft and positioned between the mounting tab and the platform bracket, the foot bracket being formed with a slot alignable with the hole in the platform bracket; and a fastener passing through the hole and the slot for securing the platform bracket to the foot bracket;

a stop element fixed on the shaft and engageable with the seat for limiting the range of pivotable movement of the seat; and a bushing secured to the lower surface of the seat, the bushing having an inner bearing surface for rotatably supporting the shaft therein.

* * * * *

UNITED STATES PATENT AND TRADEMARK OFFICE

CERTIFICATE OF CORRECTION

PATENT NO. : 5,899,531

DATED : May 4, 1999

INVENTOR(S) : Karl J. Koehler

It is certified that error appears in the above-indentified patent and that said Letters Patent is hereby corrected as shown below:

Claim 11, col. 9, line 29, after "members" insert -- , --; Claim 11, col. 9, line 36, after "member" insert -- , --; Claim 11, col. 9, line 43, after "sidewalls" insert -- , --; Claim 12, col. 9, line 58, after "supports" insert -- , --; Claim 12, col. 9, line 60, delete "rotatable" and substitute therefor -- rotatably --; Claim 12, col. 9, line 62, after "shaft" insert -- , --; Claim 12, col. 10, line 2, after "seat" insert -- , --; Claim 21, col. 11, line 7, delete "herein" and substitute therefor -- wherein --; Claim 23, col. 11, line 15, after "supports" insert -- , --; Claim 23, col. 11, line 17, after "direction" (3rd occurrence) insert -- , --; Claim 23, col. 11, line 19, after "supports" insert -- , --; Claim 23, col. 11, line 23, after "shaft" insert -- ; --; Claim 23, col. 11, line 25, after "seat" insert -- , --; Claim 23, col. 11, line 32, after "seat" insert -- , --; Claim 24, col. 11, line 37, after "supports" insert -- , --;

UNITED STATES PATENT AND TRADEMARK OFFICE

CERTIFICATE OF CORRECTION

PATENT NO. : 5,899,531

DATED : May 4, 1999

INVENTOR(S) : Karl J. Koehler

It is certified that error appears in the above-indentified patent and that said Letters Patent is hereby corrected as shown below:

Claim 24, col. 11, line 41, after "supports" insert -- , --; Claim 24, col. 11, line 43, delete "rotatable" and substitute therefor -- rotatably --; Claim 24, col. 11, line 48, after "bushing" insert -- , --.

Signed and Sealed this

Twenty-third Day of November, 1999

*Attest:*

Q. TODD DICKINSON

*Attesting Officer*

*Acting Commissioner of Patents and Trademarks*